United States Patent [19]

Allan

[11] Patent Number: 4,930,490

[45] Date of Patent: Jun. 5, 1990

[54] GAS LOG APPARATUS

[75] Inventor: Alexander Allan, Scarborough, Canada

[73] Assignee: Gas Application Products (GAP) Inc., Downsview, Canada

[21] Appl. No.: 357,775

[22] Filed: May 30, 1989

[51] Int. Cl.[5] ..... F24C 3/04; F23Q 2/32

[52] U.S. Cl. ..... 126/92 R; 126/512; 126/157 B; 431/125

[58] Field of Search ..... 126/512, 152 R, 152 A, 126/166, 540, 85 R, 92 R; 431/125, 202, 354

[56] References Cited

U.S. PATENT DOCUMENTS

| | | | |
|---|---|---|---|
| 263,255 | 8/1882 | Verity . | |
| 344,808 | 7/1886 | Bradberry . | |
| 819,260 | 5/1906 | Whitney | 126/512 |
| 1,017,751 | 2/1912 | Hansen | 126/512 |
| 2,084,566 | 6/1937 | Warfield | 431/125 X |
| 3,291,861 | 5/1968 | Brooks | 126/92 |
| 3,382,861 | 5/1968 | Peterson | 126/92 |
| 3,543,741 | 12/1970 | Whitehead | 126/92 |
| 3,747,585 | 7/1973 | Coats | 431/125 |
| 4,418,456 | 12/1983 | Riehl | 431/354 |
| 4,637,372 | 1/1987 | Mogol | 126/127 |
| 4,643,670 | 2/1987 | Edwards et al. | 431/202 |
| 4,838,240 | 6/1989 | Rieger | 126/512 X |

FOREIGN PATENT DOCUMENTS

| | | | |
|---|---|---|---|
| 52117 | 3/1984 | Japan | 431/354 |

*Primary Examiner*—Larry Jones

*Attorney, Agent, or Firm*—Ridout & Maybee

[57] ABSTRACT

Gas log apparatus utilizes a burner in which a gas/air mixture is distributed to burner ports by a flat horizontal plenum chamber supported by a grate. The ports are rectangular, and formed in lateral ridges in the plenum chamber beneath and to either side of a laterally extending artificial log supported above the plenum chamber. The log is the middle of three logs arranged one behind the other and successively stepped upwardly, the middle and rear logs being supported by cantilevered extensions from the rear of the grate. The ports have varying width and spacing, which together with their sharply angled configuration, contributes to a lifelike appearance of the flames without causing excessive carbon monoxide emission.

6 Claims, 2 Drawing Sheets

GAS LOG APPARATUS

BACKGROUND OF THE INVENTION

1. Field of the Invention

This invention relates to a gas fired appliance simulating a log fire.

2. Review of the Art

Fireplace appliances fired by gas and which simulate a natural log or coal fire have long been known. In designing such appliances, particularly under modern conditions, two conflicting requirements must be reconciled. It is desirable to provide a simulation of a natural log fire which is as lifelike as possible, but at the same time to keep emissions of carbon monoxide as low as possible. Unfortunately, common methods of providing natural looking flame effects tend to result in incomplete combustion of the gas and thus increased carbon monoxide emissions.

Early examples of this type of appliance, typified by U.S. Pat. No. 263,255 issued to Verity in 1882 and U.S. Pat. No. 344,808 issued to Bradberry in 1886, utilise a perforated plenum fed with a gas/air mixture and covered with artificial coals of non-combustible material. The gas/air mixture necessarily contacts the coals before it is completely combusted, and the resulting cooling may readily result in incomplete combustion.

The problems discussed above were later recognized and are discussed in U.S. Pat. No. 3,291,116 issued to Brooks in 1966. Brooks points out that when conventional gas burners are used in a manner such as will achieve satisfactory combustion, the flames produced are small and of uniform height, making it impossible to obtain lifelike effects. Brooks' solution to this problem is to place his burner between transversely extending logs and surround it by an accelerator hood which induces flames which are said to be much higher and more natural looking. The arrangement requires rather careful design if it is to work properly, as acknowledged in column 4 of the Brooks patent, and is affected too greatly by variations in gas pressure to provide a safe and consistent solution to the problem of providing a natural looking flame effect.

U.S. Pat. No. 3,382,861, issued in 1968 to Peterson, also makes use of a burner hidden between two transverse logs. The burner has longitudinally elongated ports which appear to be fed with neat gas to provide a sheet flame which is deflected by air currents back against the rear log. Such an arrangement is likely to result in incomplete combustion, and it is not believed that it would meet the current standards applied by the American Gas Association.

U.S. Pat. No. 3,543,741, issued in 1970 to Whitehead, acknowledges the importance of allowing combustion to be substantially completed prior to any contact with the logs, and uses flame deflectors to achieve this. If such a deflector is to avoid cooling the burning gases so as to result in incomplete combustion, it must be able to reach and withstand very high temperatures. It is not apparent how the patentee achieves the large flame height shown in his drawings whilst achieving complete combustion.

U.S. Pat. No. 4,637,372 issued in 1987 to Mogol shows a further arrangement with a burner located between two transverse logs, but the burner is operated by liquid fuel and does not offer any teaching which would assist in resolving the problems set forth above.

SUMMARY OF THE INVENTION

I have now found that by suitable location, configuration and arrangement of the burner ports, and careful control of the gas/air mixture applied to those ports, it is possible to achieve enhanced flame effects in terms of natural appearance without increasing carbon monoxide emissions above permissible limits.

According to the invention, an apparatus simulating a natural log fire comprises a grate, at least two artificial logs supported in the grate so as to extend laterally thereof with a laterally extending vertical opening between them, and a burner assembly supported by the grate, the burner assembly including a gas nozzle, air induction means associated with the nozzle to produce a fuel/air mixture, and a plenum chamber receiving the mixture and defining a laterally extending row of polygonal burner ports directed upwardly beneath said vertical opening, the ports being formed at the apex of an inverted V-shaped ridge in an upper wall of the plenum chamber, by openings extending vertically through said upper wall, the ports being of varying lateral extent and spacing, and having sharply angled vertices. The ports are preferably rectangular.

In a preferred arrangement, the apparatus includes front, middle and rear laterally extending logs supported by the grate in positions spaced one behind another and stepped one above another with laterally extending vertical openings to front and rear of the middle log, and the plenum chamber is in the form of a flat panel spaced beneath the centre log, with burner ports formed in two spaced parallel ridges of inverted V-shaped cross-section extending laterally beneath said openings. Preferably also the grate incorporates forwardly cantilevered extensions from the rear of the grate, the extensions providing stepped supports for the middle and rear logs.

Further features of the invention will be apparent from the following description of a preferred embodiment thereof.

DESCRIPTION OF THE PREFERRED EMBODIMENT

Figure 4:
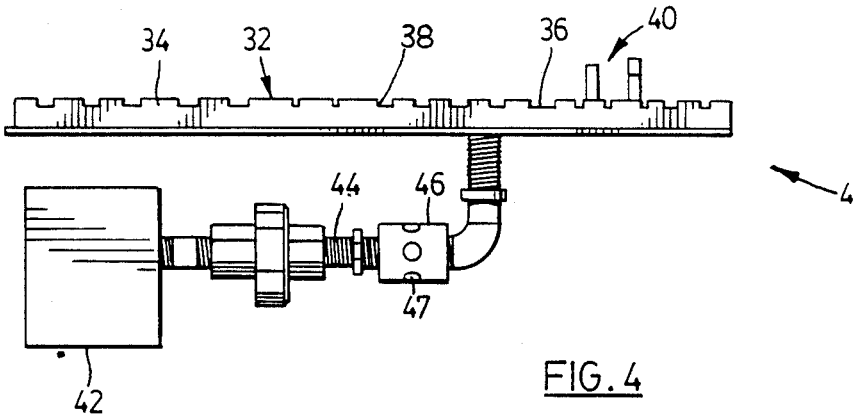
FIG. 4 is a front elevation of the burner assembly.

The apparatus comprises a grate 2, a burner assembly 4, and a number of artificial firelogs, five in number in the example shown. Although only front, middle and rear logs 6, 8 and 10 are important functionally, two additional small logs 12 and 14 are provided for aesthetic reasons only. The logs are formed in a known manner from a heat resistant cement aggregate.

The grate is formed by welding from heavy gauge steel strip. Two spaced lateral grate bars 16 and 18 are turned down at their outer ends to form front and rear support legs 20 and 22, and are connected by front to rear grate bars 24 and 26, which may converge towards the rear so as to provide a better fit in conventionally configured fireplaces. The bars 26 are extended at their rear ends, first upwardly and then forwardly, downwardly and forwardly again, to form two steps 28 and 30 upon which the logs 10 and 8 are located. The log 6 rests on the grate bars in front of the bar 16. The arrangement is such that the logs are stepped upwardly one behind the other and spaced in the front to rear direction so that there are laterally extending vertical openings in front and behind the middle log, these openings being about 1.5 inches wide.

Figure 5:
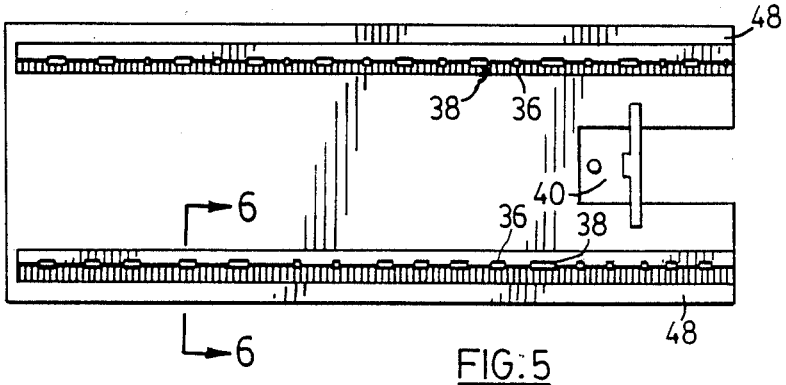
FIG. 5 is a plan view of the burner assembly.
Figure 6:
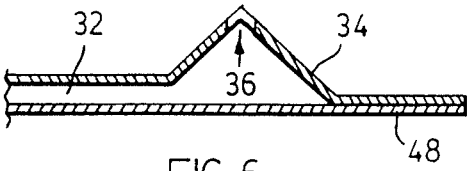
FIG. 6 is a fragmentary cross-section on the line 6—6 in FIG. 5.
Figure 1:
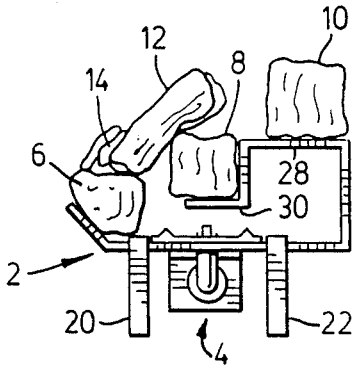
FIG. 1 is an end elevation of apparatus in accordance with the invention.
Figure 2:
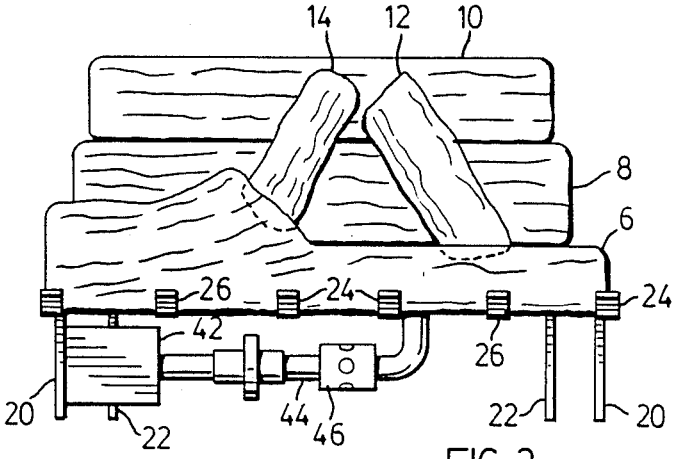
FIG. 2 is a front elevation of the apparatus.
Figure 3:
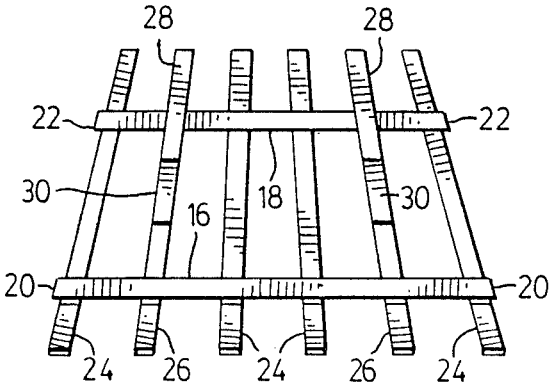
FIG. 3 is a plan view of the grate of the apparatus, with the logs and burner assembly removed.

The burner assembly 4 is secured on the grate between the bars 16 and 18. It has a generally flat pan-like plenum chamber 32 with raised laterally extending upper wall portions 34 spaced from its front and rear edges by margins 48. These raised portions (see FIG. 6) have an inverted V-shaped cross-section, and each is formed at its apex with a row of ports 36. These ports are rectangular, with vertical walls, and have sharply angled vertices 38. Their longitudinal extent and spacing in the transverse direction are varied in a random or semi-random manner, as best seen in FIG. 5. The plenum chamber is recessed at one end to receive a conventional pilot light assembly 40 which is provided with an independent connection (not shown) to a conventional control unit 42 connected between a gas supply and a gas/air mixer assembly coupling the control unit to the plenum chamber 32. The mixer assembly comprises an orifice holder 44, containing a calibrated nozzle, and a mixing chamber 46 having calibrated openings 47 for admitting air for mixing with by gas emerging from the nozzle. This arrangement is conventional except that, in order to avoid tampering which might upset factory determined combustion characteristics of the device, no adjustments of the nozzle or of the air orifices are provided.

In use, the apparatus is installed in a fireplace and the control unit 42 is coupled to a gas supply. A pilot jet in the pilot light assembly is lit, and when a sensor in the assembly confirms that the pilot is lit, the control unit permits admission of gas at regulated pressure to the nozzle in orifice holder 44. This generates a gas/air mixture which leaves the plenum chamber 32 through the ports 36 in conventional manner. Thus far operation is conventional. The design of the plenum chamber however affects the characteristics of the flames produced. The ports are at the apices of the V-shaped ridges, and have sharply angled corners or vertices, as well as varying longitudinal dimensions and spacing. The sharp vertices provide local turbulence which affects the combustion characteristics of the flame, again in a local manner, so as to produce a more ragged yellow and luminous flame; since only the combustion characteristics of a small portion of the emerging gas are affected, there is little deterioration in the overall emission characteristics of the burner, and required emission standards can be met, especially if precautions (such as lack of user adjustments to the air mixture arrangements) are taken to maintain an optimal factory setting of the gas/air mixture ratio, according to known techniques.

The configuration of the plenum chamber 36, and its relationship to the grate structure, are such that it largely blocks the area between the bars 16 and 18, with at most only a narrow gap between the bars and the chamber. Additional air reaching the vicinity of the ports must thus flow laterally over the plenum chamber or the grate bars, which slows down this air flow and introduces a lateral movement component into the flames. This deceleration of the air flow in which the flames are propagated, together with the lateral movement, further contributes to a life like appearance and substantial height of the flames, which vary both from one another and in the amount in which they are coalesce, because of the variations in width and spacing of the ports. A lifelike effect is further assisted by concentrating the action of the burner around the middle log, which is supported about two inches about the plenum chamber and between the two raised portions 34 containing the burner ports 36. Thus additional air is drawn in laterally between the plenum chamber 36 and the log 8, and over the bars 16 and 18, to help provide lifelike flame effects both in front of and behind the log 8.

Various changes can be made in the apparatus without departing from the scope of the invention as set forth in the appended claims. Thus the shapes of the ports could be changed from rectangular to other polygonal forms, provided that the sharp vertices are retained, and the dimensions of the parts, where stated, can be changed to provide apparatus for different sizes of fireplaces or having different log arrangements.

I claim:

1. An apparatus simulating natural log fire, comprising a grate, at least two artificial logs supported in the grate so as to extend laterally thereof with a laterally extending vertical opening between them, and a burner assembly supported by the grate, the burner assembly including a gas nozzle, air induction means associated with the nozzle to produce a fuel/air mixture, and a plenum chamber receiving the mixture and defining a laterally extending row of polygonal burner ports directed upwardly beneath said vertical opening, the ports being formed at the apex of an inverted V-shaped ridge in an upper wall of the plenum chamber, by openings extending vertically through said upper wall, the ports being of varying lateral extent and spacing, and having sharply angled vertices.

2. Apparatus according to claim 1, wherein the ports are rectangular.

3. Apparatus according to claim 1, wherein the raised portion of the plenum chamber is flanked forwardly and rearwardly by generally horizontal surfaces over which air entrained by the gas from the burner ports may flow.

4. Apparatus according to claim 1, including front, middle and rear laterally extending logs supported by the grate in positions spaced one behind another and stepped one above another with laterally extending vertical openings to front and rear of the middle log, and the plenum chamber is in the form of a flat panel spaced beneath the centre log, with burner ports formed in two spaced parallel ridges of inverted V-shaped cross-section extending laterally beneath said openings.

5. Apparatus according to claim 4, wherein the grate incorporates forwardly cantilevered extensions from the rear of the grate, the extensions providing stepped supports for the middle and rear logs.

6. Apparatus according to claim 1, wherein the gas nozzle and air induction means have fixed settings.

* * * * *